US009453355B1

(12) United States Patent
Rasp

(10) Patent No.: US 9,453,355 B1
(45) Date of Patent: Sep. 27, 2016

(54) POOL VACUUM

(71) Applicant: Robert E. Rasp, Semmes, AL (US)

(72) Inventor: Robert E. Rasp, Semmes, AL (US)

( * ) Notice: Subject to any disclaimer, the term of this patent is extended or adjusted under 35 U.S.C. 154(b) by 267 days.

(21) Appl. No.: 14/288,101

(22) Filed: May 27, 2014

(51) Int. Cl.
*E04H 4/16* (2006.01)

(52) U.S. Cl.
CPC ..... *E04H 4/1645* (2013.01)

(58) Field of Classification Search
CPC . E04H 4/1636; E04H 4/1645; E04H 4/1654; E04H 4/1672
See application file for complete search history.

(56) References Cited

U.S. PATENT DOCUMENTS 3,972,339 A 8/1976 Henkin et al.
4,141,101 A * 2/1979 Gibellina ..... E04H 4/1681 15/1.7
4,849,024 A * 7/1989 Supra ..... E04H 4/1654 134/21
5,933,899 A 8/1999 Campbell et al.
6,412,133 B1 * 7/2002 Erlich ..... E04H 4/1654 15/1.7
6,782,578 B1 8/2004 Rief et al.
6,942,790 B1 9/2005 Dolton
6,984,315 B2 * 1/2006 Dolton, III ..... E04H 4/1609 15/1.7
7,165,284 B2 1/2007 Erlich et al.
8,402,585 B2 3/2013 Rief et al.
2003/0208862 A1 * 11/2003 Henkin ..... E04H 4/1654 15/1.7

* cited by examiner

*Primary Examiner* — Nicole Blan
(74) *Attorney, Agent, or Firm* — George L Williamson

(57) ABSTRACT

Method and apparatus for a pool vacuum having a wheeled vacuum head having an internal rotating impeller driven by water pressure from a hose connected to the water return inlet of the pool wherein the internal impeller shares a common shaft with a propeller extending into the vacuum head so that the impeller turns the propeller which in turn creates a powerful, upward water flow which will lift leaves, debris and trash from the bottom of the pool upwardly through a housing and into a filter mounted on the upper end portion of the pool vacuum.

10 Claims, 3 Drawing Sheets

POOL VACUUM

BACKGROUND OF THE INVENTION

1. Field of the Invention

The present invention relates generally to swimming pool accessories and, more particularly, is concerned with a pool vacuum.

2. Description of the Related Art

Devices relevant to the present invention have been described in the related art, however, none of the related art devices disclose the unique features of the present invention.

In U.S. Pat. No. 7,165,284 dated Jan. 23, 2007, Erlich, et al., disclosed a water jet reversing propulsion and directional controls for automated swimming pool cleaners. In U.S. Pat. No. 3,972,339 dated Aug. 3, 1976, Henkin, et al., disclosed an automatic swimming pool cleaner. In U.S. Pat. No. 6,942,790 dated Sep. 13, 2005, Dolton disclosed an open air filtration cleaning device for pools and hot tubs. In U.S. Pat. No. 6,782,578 dated Aug. 31, 2004, Rief, et al., disclosed a swimming pool pressure cleaner with internal, steering mechanism. In U.S. Pat. No. 5,933,899 dated Aug. 10, 1999, Campbell, et al., disclosed a low pressure, automatic swimming pool cleaner. In U.S. Pat. No. 8,402,585 dated Mar. 26, 2013, Rief, et al., disclosed a convertible pressure/suction swimming pool cleaner. While these devices may be suitable for the purposes for which they were designed, they would not be as suitable for the purposes of the present invention as hereinafter described.

SUMMARY OF THE PRESENT INVENTION

The present invention discloses a pool vacuum for removing leaves, trash and other debris from a swimming pool in a highly efficient manner. The pool vacuum comprises a wheeled vacuum head having an internal rotatable impeller driven by water pressure conveyed through a hose connected to the water return inlet of the pool wherein the internal impeller shares a common depending shaft with a propeller extending into the vacuum head so that the impeller turns the propeller so as to create a powerful, upward water flow which will lift leaves, debris and trash from the bottom of the pool up through a housing and into a filter mounted on the upper end portion of the pool vacuum. The impeller is mounted inside an impeller housing having a depending shaft extending downwardly upon which the propeller is mounted. The outward water flow from the impeller housing is also directed upwardly through a separator plate and top portion having a plurality of discharge ports thereon to provide additional water flow upwardly toward the filter. A handle is provided on the pool vacuum so that a user can manually move the pool vacuum about the interior surfaces of the swimming pool.

An object of the present invention is to provide an improved pool vacuum for a swimming pool. A further object of the present invention is to provide a pool vacuum driven by water pressure from the return inlet water hose which water flow is caused by water pressure from the pump of the pool which water pressure is otherwise wasted. A further object of the present invention is to provide a more powerful pool cleaner for lifting difficult to remove items from the pool. A further object of the present invention is to provide a pool cleaner which is relatively easy to use. A further object of the present invention is to provide a pool cleaner which can be relatively inexpensively and easily manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
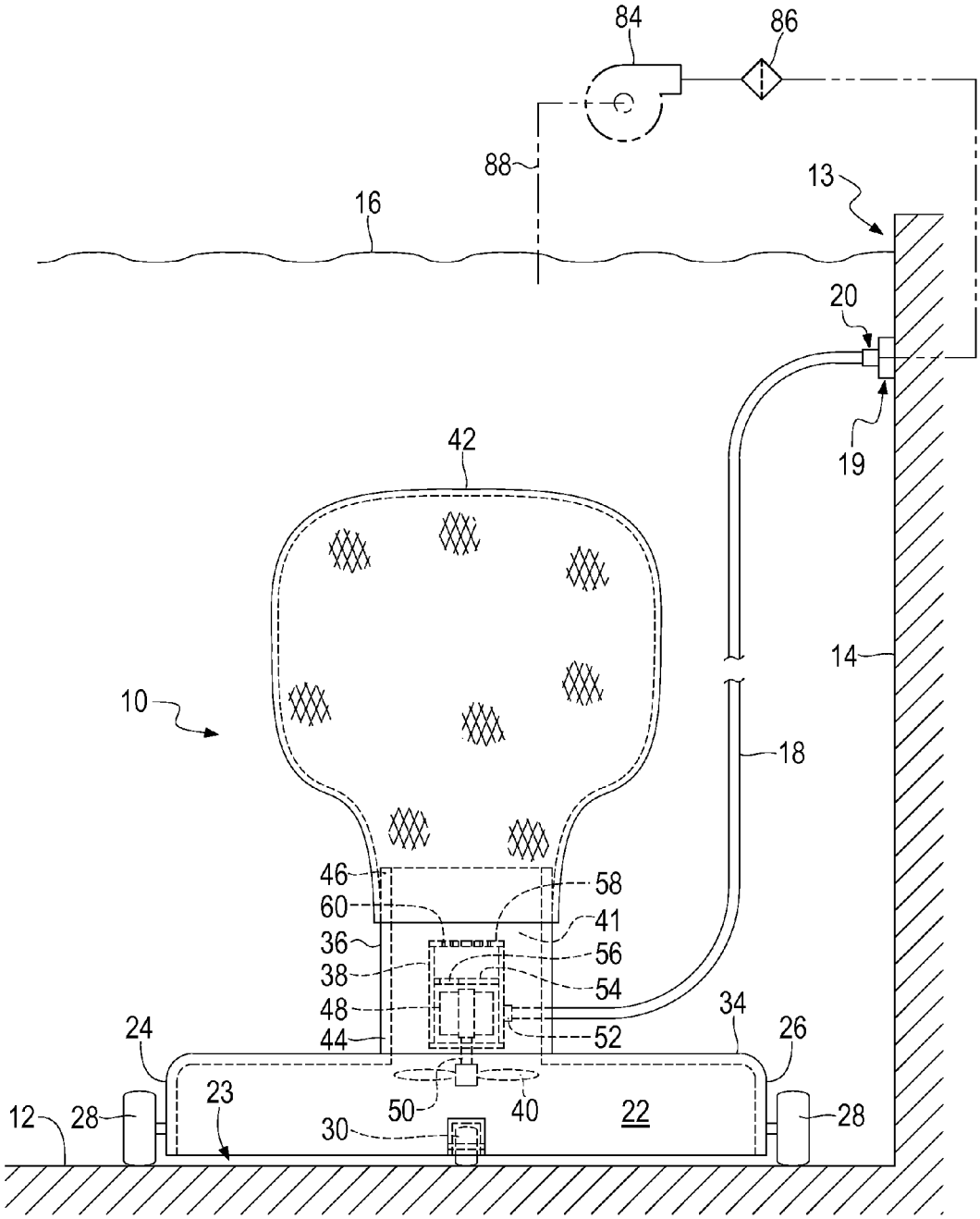
FIG. 1 is a front elevation view of the present invention.

With regard to reference numerals used, the following numbering is used throughout the drawings.

10 present invention
12 bottom of pool
13 swimming pool
14 side of pool
16 water surface
18 return inlet hose
19 return inlet
20 connection to return inlet
22 vacuum head
23 suction opening
24 right side
26 left side
28 side wheel
30 front wheel
32 rear wheel
34 deck
36 outer housing
38 inner housing
40 propeller
41 interior space
42 filter
43 direction arrow
44 lower end
46 upper end
48 impeller
49 blades
50 shaft of impeller
52 water inlet
54 separator plate
55 chamber
56 discharge port
58 top

59 bottom
60 discharge port
62 handle
64 hand grip
66 connecting point
68 pivoting attachment
69 pressurized water supply flow
70 direction arrow
71 direction arrow
72 mounting bracket
74 squirrel cage impeller
76 top
78 horizontal outlet
80 vertical outlet
82 gear assembly
84 pump
86 fitter
88 inlet line

DETAILED DESCRIPTION OF THE PREFERRED EMBODIMENT(S)

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 4 illustrate the present invention wherein a pool vacuum is disclosed and which is generally indicated by reference number 10.

Turning to FIG. 1, therein is shown the present invention 10 wherein a pool vacuum is shown cleaning the bottom 12 of a swimming pool 13 having sides 14 and a water surface 16 along with a return inlet hose 18 which is returned water pumped into the pool from the pool pump. The present invention 10 is shown using the inlet hose 18 being connected at 20 to the return inlet 19 on the side 14 of the pool 13. The present invention 10 has vacuum head 22 on its lower end having left and right side portions 26, 24 each having a side wheel 28 thereon along with front and rear wheels 30, 32, best shown in FIG. 2. The vacuum head 22 has an upper deck or surface 34 upon which is mounted a larger, outer housing 36 which is hollow on the inside containing an inner housing 38 along with a propeller 40 near its lower intake end. The interior of the outer housing 36 provides a inner water flow conduit 41 extending from the interior of the vacuum head to the upper filter 42 which may be a mesh bag. The lower end 44 of the outer housing 36 is mounted onto the surface of the deck 34 and the filter 42 is attached to the upper end 46 of the outer housing. Contained inside the outer housing 36 is an inner housing 38 containing an impeller 48 therein which may be a rotary impeller of various types mounted onto an upper end of a shaft 50 and having the propeller 40 connected to its lower end wherein the impeller (best seen in FIG. 3) is driven by the high pressure water flow of the return inlet hose 18 which connects to the inner housing at inlet 52. Also shown inside the inner housing 38 is a separator plate 54 above the impeller 48 having a discharge port 56 in the separator plate 54 and a top 58 having a plurality of discharge ports 60 therein. It would be clear to one skilled in the an that the impeller 48 is turned on its shaft 50 by water carried through the inlet hose 18 which in turn rotates the propeller 40 on shaft 50 creating an upward flow of water from the interior of vacuum head 22 upwardly to the filter 42. Also, water flow exits the inner housing 38 through the discharge port 56 in the separator plate 54 and the multiple discharge ports 60 of the top of the inner housing. Also, shown in phantom line for illustration only, is a pool pump 84 and filter 86 receiving water from swimming pool 14 through inlet line 88 and returning water to the swimming pool through the return inlet 19 as would be done in the standard manner by one skilled in the art.

Figure 2:
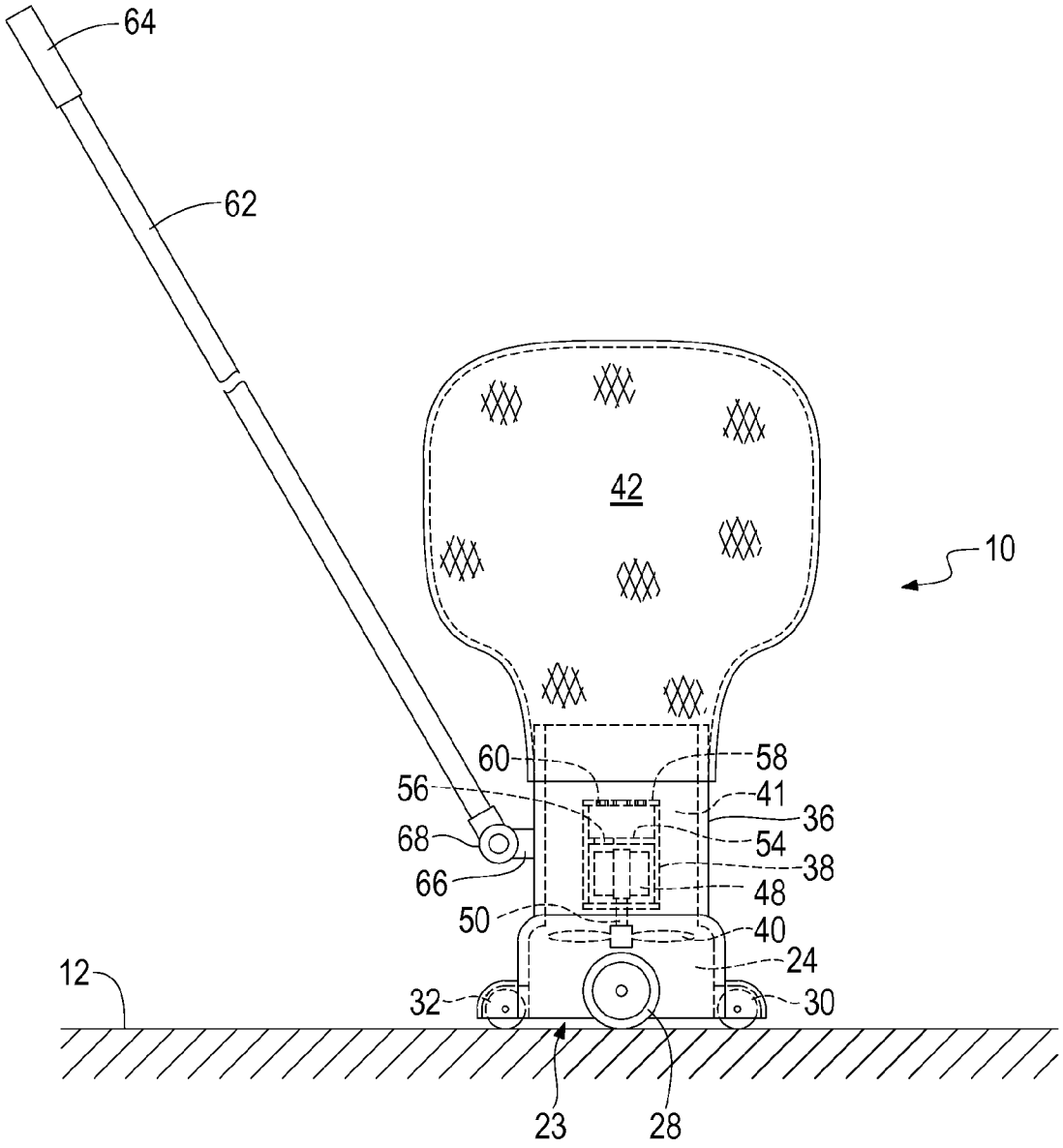
FIG. 2 is a side elevation view of the present invention.

Turning to FIG. 2, therein is shown the present invention 10 wherein a pool vacuum is shown cleaning the bottom 12 of a swimming pool 13 having sides 14 and a water surface 16 along with a return inlet hose 18 which is returned water pumped into the pool from the pool pump. The present invention 10 is shown using the inlet hose 18 being connected at 20 to the return inlet 19 on the side 14 of the pool 13. The present invention 10 has vacuum head 22 on its lower end having left and right side portions 26, 24 each having a side wheel 28 thereon along with front and rear wheels 30, 32, best shown in FIG. 2. The vacuum head 22 has an upper deck or surface 34 upon which is mounted a larger, outer housing 36 which is hollow on the inside containing an inner housing 38 along with a propeller 40 near its lower intake end. The interior of the outer housing 36 provides a water flow conduit 41 extending from the interior of the vacuum head to the upper filter 42 which may be a mesh bag. The lower end 44 of the outer housing 36 is mounted onto the surface of the deck 34 and the filter 42 is attached to the upper end 46 of the outer housing. Contained inside the outer housing 36 is an inner housing 38 containing an impeller 48 inside which may be a rotary impeller of various types mounted onto an upper end of a shaft 50 and having the propeller 40 connected to its lower end wherein the impeller (best seen in FIG. 3) is driven by the high pressure water flow shown by arrow 69 and conveyed through the inlet hose 18 which connects to the inner housing at inlet 52. Also shown inside the inner housing 38 is a separator plate 54 above the impeller 48 having a discharge port 56 in the separator plate 54 and a top 58 having a plurality of discharge ports 60 therein. It would be clear to one skilled in the an that the impeller 48 is turned on its shaft 50 by water carried through the inlet hose 18 which in turn rotates the propeller 40 on shaft 50 creating an upward flow of water from the interior of vacuum head 22 upwardly to the filter 42. Also, water flow exits the inner housing 38 through the discharge port 56 in the separator plate 54 and the multiple discharge ports 60 of the top of the inner housing. Also shown is handle 62 having an upper hand grip 64 being connected to rear of the outer housing 36 of the pool vacuum 10 at a connection point 66 and also showing the handle having an angularly pivoting attachment 68. Other previously disclosed elements may also be shown.

Figure 3:
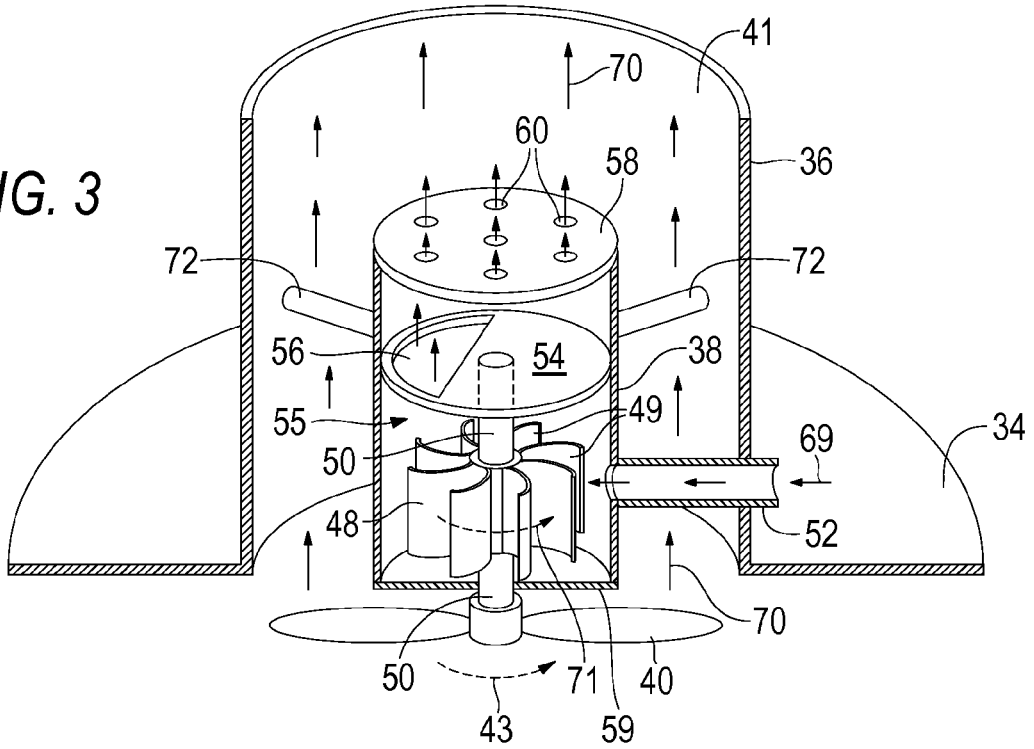
FIG. 3 is a perspective view of the inner housing of the present invention showing one embodiment of the present invention.

Turning to FIG. 3, therein is shown the outer housing 36 mounted onto a portion of the deck 34 containing the inner housing 34 therein and having the impeller 48 therein mounted on a shaft 50 showing the propeller 40 on its lower end along with a direction arrow 43 showing rotation of propeller and direction arrows 70 showing the direction of the water flow created by the rotation of the propeller 40. Water from the inlet hose (not shown, but see item 18. FIG. 1) connected to inlet 52 is directed across the impeller 48 so as to cause it to rotate as shown by direction arrow 71 which in turn turns the propeller 40 as previously disclosed wherein the water from the interior of the inner housing 38 travels upwardly through a discharge port 56 of the separator plate 54 and then out through the discharge ports 60 of the top 58. Also shown are a plurality of spaced apart mounting brackets 72 which secure the inner housing 38 to the interior of the outer housing 36. Other previously disclosed elements may also be shown.

Figure 4:
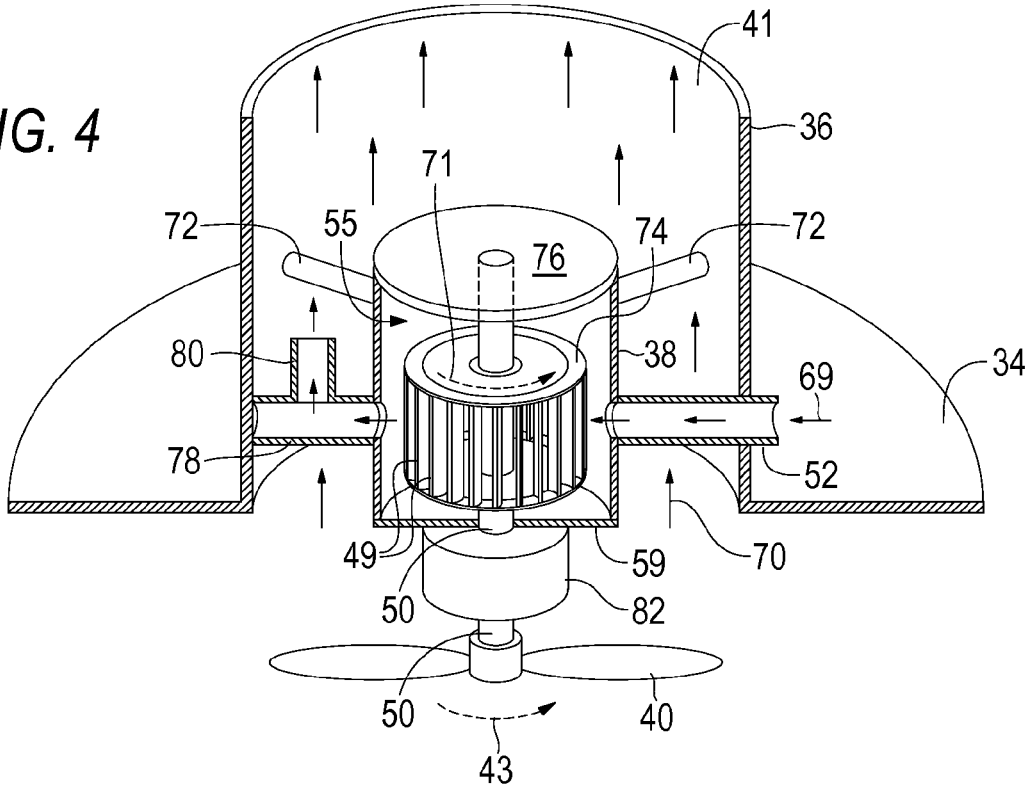
FIG. 4 is a perspective view of the inner housing of the present invention showing a second embodiment of the present invention.

Turning to FIG. 4, therein is shown the outer housing 36 mounted onto a portion of the deck 34 containing the inner housing 34 therein and having the impeller 48 therein mounted on a shaft 50 showing the propeller 40 on its lower end along with a direction arrow 43 showing rotation of propeller and direction arrows 70 showing the direction of the water flow created by the rotation of the propeller 40. Water from the inlet hose (not shown, but see item 18, FIG. 1) connected to inlet 52 is directed across the impeller 48 so as to cause it to rotate as shown by direction arrow 71 which in turn turns the propeller 40 as previously disclosed wherein the water from the interior of the inner housing 38 travels upwardly through a discharge port 56 of the separator plate 54 and then out through the discharge ports 60 of the top 58. Also shown are a plurality of spaced apart mounting brackets 72 which secure the inner housing 38 to the interior of the outer housing 36. Also shown is a squirrel cage type impeller 74 which could be used in place of the conventional open blade or vane type impeller 48 previously shown. Either of the impellers 48, 74 could be used depending on the design choice of the builder. Also shown is a top 76 of the inner housing 38 having no discharge ports as with the previously disclosed embodiment but instead having a discharge outlet 78 passing laterally from the side of the inner housing 38 and then out the outlet 80 in an upward direction wherein the discharge 78 also acts as an additional brace similar to previously disclosed brace 72 for securing the inner housing 38 to the wall of the outer housing 36. Also shown is an optional conventional gear assembly or transmission 82 which would provide a mechanical advantage to the impeller 48, 74 so as to provide increased torque for turning the propeller 40. Other previously disclosed elements may also be shown.

Direction arrows shown in FIGS. 1-4 are used throughout this specification to show direction of water flow, movement, or other activity/action described herein.

By way of further explanation and by reference to FIGS. 1-4 the following summary is provided of the present invention 10 which includes a pool vacuum for cleaning the bottom and side wall surfaces 12, 14 of a swimming pool 13, the swimming pool having a water pump 84 for removing water from the swimming pool and returning a pressurized water supply flow to the swimming pool through a water return inlet 19 including the following: a) at a vacuum head 22, a plurality of wheels 28, 30, 32 disposed on the vacuum head so that the vacuum head can be rolled about in the swimming pool, the vacuum head being configured to have a suction opening 23 at a bottom portion thereof proximate a surface of the swimming pool; b) a rotary impeller 48, the rotary impeller having a plurality of blades 49 thereon and a shaft 50 depending therefrom and extending into the vacuum head, wherein the shaft is turned by the rotary impeller; c) wherein the rotary impeller is driven by the pressurized water supply flow 69 from the water return inlet of the swimming pool; d) a propeller 40 is disposed on the shaft so that the propeller rotates in response to rotation of the rotary impeller, wherein rotation of the propeller causes an upward flow of water 70 through the suction opening and the vacuum head so that debris is removed from the bottom and side wall surfaces of the swimming pool; e) a filter 42 is disposed on the pool vacuum for collecting debris removed by the upward flow of water; and, f) an elongated handle 62 is disposed on the pool vacuum so that the pool vacuum can be moved about by a user. Furthermore, an outer housing 36 is disposed on the vacuum head, the outer housing having an upper 46 and a lower end 44 portion, wherein the lower end is disposed on the vacuum head, wherein the filter is disposed on the upper end of the outer housing, wherein the outer housing has an interior space 41 therein so the upward flow of water passes through the interior space from the vacuum head to the filter. Furthermore, an inner housing 38 is disposed inside the outer housing, wherein the rotary impeller is disposed inside the inner housing, the inner housing having upper 58 and lower end 59 portions. Furthermore, a separator plate 54 is disposed inside the inner housing so as to form a chamber 55 containing the rotary impeller, a water inlet 52 disposed on the chamber for receiving the pressurized water supply flow from the water return inlet so that the rotary impeller is driven by the pressurized water supply flow from the water return inlet of the swimming pool. Furthermore, a hose 18 having one end connected at 20 to the water return inlet of the swimming pool and a second end connected to the water inlet 52 on the chamber delivers water from the water return inlet to the water inlet on the chamber of the inner housing so that the rotary impeller is driven by the pressurized water supply flow from the water return inlet of the swimming pool. Furthermore, the said separator plate has a discharge port 56 therein to permit pressurized water to escape from the chamber and the upper end portion of the inner housing has a plurality of discharge ports 60 therein to permit pressurized water to escape from the chamber so that water passing through the discharge ports is directed toward the filter to provide additional upward flow of water to the filter. Furthermore, in an alternate embodiment, a water outlet 78 may extend laterally from the chamber, wherein the water outlet is configured to provide an upwardly directed stream of water at 80 directed toward the filter to provide additional upward flow of water to the filter as shown by the direction arrows.

I claim:

1. A method for vacuuming the bottom and side wall surfaces of a swimming pool, the swimming pool having a water pump for removing water from the swimming pool and returning a pressurized water supply flow to the swimming pool through a water return inlet, comprising the steps of:

a) providing a vacuum head having a plurality of wheels thereon so that the vacuum head can be rolled about in the swimming pool, the vacuum head being configured to have a suction opening at a bottom portion thereof proximate a surface of the swimming pool;

b) providing a rotary impeller thereon and a shaft depending therefrom and extending into the vacuum head, wherein the shaft is rotated by the rotary impeller;

c) driving the rotary impeller with the pressurized water supply flow from the water return inlet of the swimming pool;

d) creating an upward flow of water through the suction opening and the vacuum head in response to rotation of a propeller disposed on the rotating shaft so that debris is removed from the bottom and side wall surfaces of the swimming pool;

e) filtering debris from the upward flow of water; and, f) moving the pool vacuum around the swimming pool.

2. The method of claim 1, further comprising the step of disposing an outer housing on the vacuum head, the outer housing having an upper and a lower end portion, wherein the lower end is disposed on the vacuum head, wherein the filter is disposed on the upper end of the outer housing, wherein the outer housing has an interior space therein so that the upward flow of water passes through the interior space from the vacuum head to the filter.

3. The method of claim 2, further comprising the step of disposing an inner housing inside the outer housing, wherein the rotary impeller is disposed inside the inner housing, the inner housing having upper and lower end portions.

4. The method of claim 3, further comprising the step of disposing a separator plate inside the inner housing so as to form a chamber containing the rotary impeller, a water inlet disposed on the chamber for receiving the pressurized water supply flow from the water return inlet so that the rotary impeller is driven by the pressurized water supply flow from the water return inlet of the swimming pool.

5. The method of claim 4, further comprising the step of providing a hose having one end connected to the water return inlet of the swimming pool and a second end connected to the water inlet on the chamber for delivering water from the water return inlet to the water inlet on the chamber of the inner housing so that the rotary impeller is driven by the pressurized water supply flow from the water return inlet of the swimming pool.

6. The method of claim 5, wherein the separator plate has a discharge port therein to permit pressurized water to escape from the chamber.

7. The method of claim 6, wherein the upper end portion of the inner housing has a plurality of discharge ports therein to permit pressurized water to escape from the chamber so that water passing through the discharge ports is directed toward the filter to provide additional upward flow of water to the filter.

8. The method of claim 4, further comprising the step of providing a water outlet extending laterally from the chamber, wherein the water outlet is configured to provide an upwardly directed stream of water directed toward the filter to provide additional upward flow of water to the filter.

9. The method of claim 1, wherein the rotary impeller comprises a squirrel cage impeller.

10. The method of claim 1, further comprising the step of providing a gear assembly between the rotary impeller and the propeller to provide a mechanical advantage to the rotary impeller for turning the propeller.

* * * * *